US006527210B1

(12) United States Patent
Mecklenfeld

(10) Patent No.: US 6,527,210 B1
(45) Date of Patent: Mar. 4, 2003

(54) HAMMER CRUSHER

(75) Inventor: Hermann Mecklenfeld, Ennigerloh (DE)

(73) Assignee: Krupp Fordertechnik GmbH, Essen (DE)

( * ) Notice: Subject to any disclaimer, the term of this patent is extended or adjusted under 35 U.S.C. 154(b) by 0 days.

(21) Appl. No.: 09/807,751

(22) PCT Filed: Oct. 21, 1999

(86) PCT No.: PCT/EP99/07988

§ 371 (c)(1),
(2), (4) Date: Apr. 17, 2001

(87) PCT Pub. No.: WO00/24515

PCT Pub. Date: May 4, 2000

(30) Foreign Application Priority Data

Oct. 23, 1998 (DE) ..... 198 48 866

(51) Int. Cl.[7] ..... B02C 13/26
(52) U.S. Cl. ..... 241/194

(58) Field of Search ..... 241/194, 195, 241/189.1

(56) References Cited

FOREIGN PATENT DOCUMENTS

| | | |
|---|---|---|
| FR | 1 199 926 | 12/1959 |
| FR | 1 264 941 | 5/1961 |
| FR | 2 269 375 | 11/1975 |

*Primary Examiner*—Mark Rosenbaum
(74) *Attorney, Agent, or Firm*—Herbert Dubno; Andrew Wilford

(57) ABSTRACT

A hammer crusher has a rotor disk centered on and rotatable about an axis, having a predetermined outside diameter, and formed with five angularly equispaced and radially outwardly open pockets. Respective support bolts in the cavities define on rotation of the disk an orbit of generally the same diameter as the predetermined outside disk diameter. Respective hammers pivoted on the bolts project radially from the cavities on rotation of the disk. A pentagonal-section shaft carries the disk and has facets directed radially outwardly at the respective bolts.

2 Claims, 1 Drawing Sheet

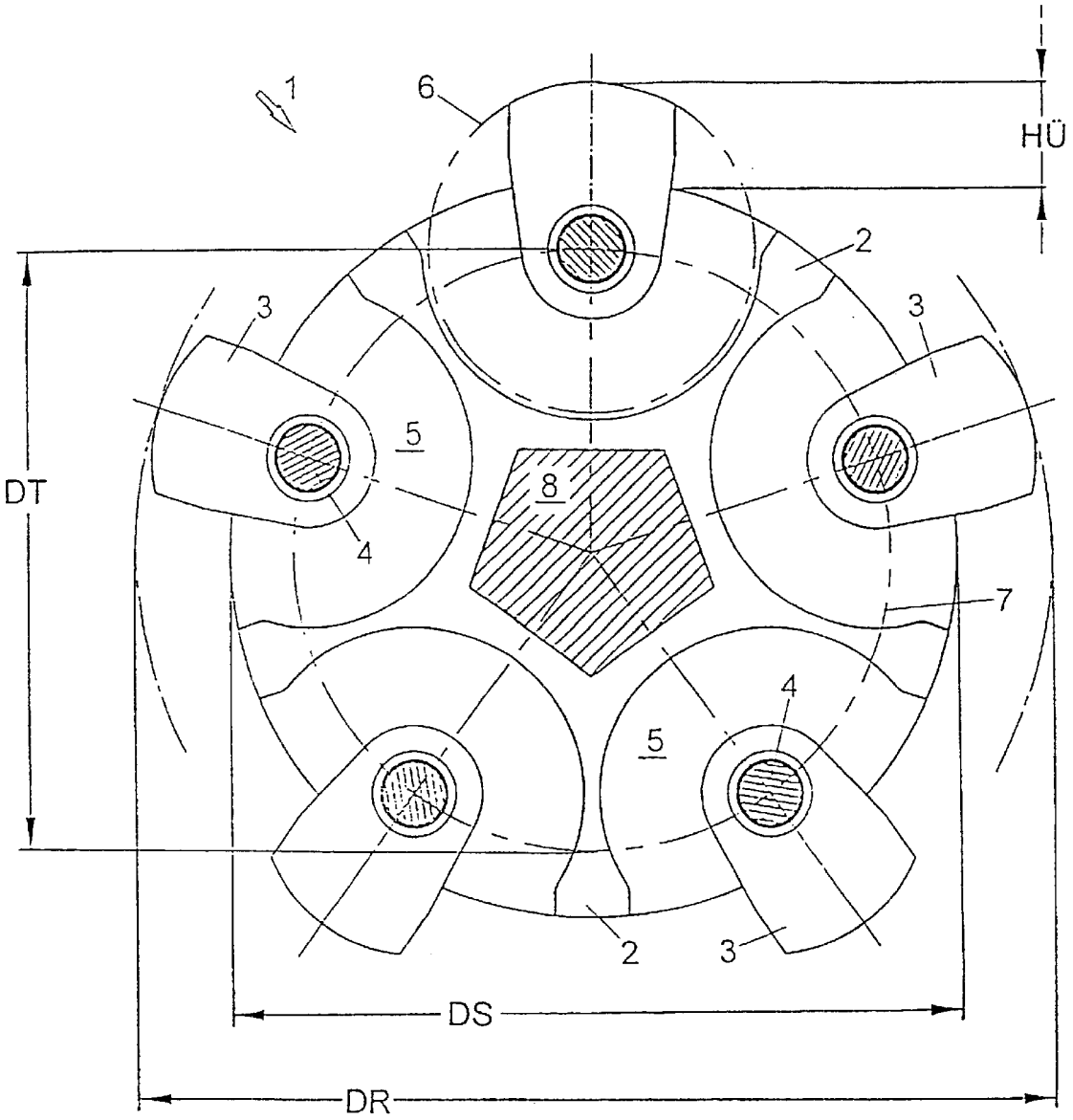
1
6
HÜ
2
3
3
5
8
DT
4
7
4
5
2
3
DS
DR

HAMMER CRUSHER

CROSS REFERENCE TO RELATED APPLICATIONS

This application is the US national phase of PCT application PCT/EP99/07988 filed Oct. 21, 1999 with a claim to the priority of German patent application 198 48 866.1 filed Oct. 23, 1998.

FIELD OF THE INVENTION

The invention relates to a hammer crusher having at least one rotor formed by at least one impact disk on whose periphery is a plurality of angularly equispaced impact hammers, each impact hammer being freely rotatable on a support bolt in a respective swing cavity.

BACKGROUND OF THE INVENTION

Hammer crushers can have several rotors and each rotor can have a plurality of adjacent impact disks whose diameters are each between 1600 and 2400 mm. Such hammer crushers generally have on each disk six breaking hammers. Because of the cavity required for the breaking hammers to pivot, the hammers of such crushers project only a small amount. The result is that large-particle material cannot be drawn in. Similarly, regardless of the type of stone being crushed, the crushing effect of the known hammer crushers is reduced.

OBJECT OF THE INVENTION

It is an object of the invention to provide a hammer crusher such that it does not have the disadvantages of the known hammer crushers.

SUMMARY OF THE INVENTION

The solution is a hammer crusher of the above-described type wherein each impact disk has five impact hammers, the difference between a diameter of the rotor and a diameter of the impact disks, and thus the hammer projection is set as large as possible, and the swing cavities for the impact hammers are spaced as closely as possible.

The larger hammer projection makes it possible to make the cross-sectional size of the impact hammers substantially larger than is possible with the known hammer crushers. As a result of the thus obtained high inertia about the respective axes of the respective support bolts the crushing effect of the individual impact hammers is substantially increased. In addition relatively large stones can be better comminuted by the impact hammers, in particularly large stones are reduced to larger pieces than is possible with the known hammer crushers. The described improvements with the hammer crusher according to the invention lead to substantially greater material throughput relative to the known hammer crushers.

In an embodiment of the invention the axle of the rotor is of pentagonal section and facets of the axle of the rotor face toward the respective swing cavities of the impact hammers.

BRIEF DESCRIPTION OF THE DRAWING

The invention is more specifically described with reference to the drawing showing an embodiment whose sole FIGURE is a section through the crusher according to the invention.

SPECIFIC DESCRIPTION

In the drawing a rotor 1 of a hammer crusher is shown having impact disks 2 each with five cavities holding respective breaking hammers 3 spaced uniformly about its periphery. Each impact hammer 3 is freely pivotal on a support bolt 4 in the respective swing cavity 5 that is slightly larger than the orbit of the respective impact hammer 3.

The difference between the diameter DR of the rotor 1 and the diameter DS of the impact disks 2 is set as large as possible so that the hammers project by a relatively large distance HÜ. This is achieved in that the swing cavities 5 are spaced as closely as possible to each other while at the same time the diameter DS of the impact disks 2 is only slightly larger than the diameter DT of an orbit 7 of the support bolts 4 for the impact hammers 3 so that the support bolts 4 are solidly anchored in the impact disks 2.

The axle 8 of the rotor 1 is of pentagonal section with facets of the pentagon each directed at a respective swing cavity 5.

What is claimed is:

1. A hammer crusher comprising:

a rotor disk centered on and rotatable about an axis, having a predetermined outside diameter, and formed with five angularly equispaced and radially outwardly open pockets;

respective support bolts in the cavities defining on rotation of the disk an orbit of generally the same diameter as the predetermined outside disk diameter;

respective hammers pivoted on the bolts and projecting radially from the cavities on rotation of the disk; and a pentagonal-section shaft carrying the disk and having facets directed radially outwardly at the respective bolts.

2. The hammer crusher defined in claim 1 wherein the disk has a diameter between 1600 mm and 2400 mm.

* * * * *